United States Patent [19]

Griffin

[11] Patent Number: 4,966,369

[45] Date of Patent: Oct. 30, 1990

[54] POSITIVE ROTATIONAL STABILITY PUTTER

[76] Inventor: Roy N. Griffin, P.O. Box 8438, Horseshoe Bay, Tex. 78654

[21] Appl. No.: 356,328

[22] Filed: May 23, 1989

[51] Int. Cl.[5] ..... A63B 53/04

[52] U.S. Cl. ..... 273/80 A; 273/80 C; 273/167 G; 273/167 F; 273/164

[58] Field of Search ..... 273/164, 167–175, 273/80 C, 80 A; D21/214–220

[56] References Cited

U.S. PATENT DOCUMENTS

| | | | |
|---|---|---|---|
| D. 211,103 | 5/1968 | Cook | D21/217 |
| D. 221,446 | 8/1971 | Cook | D21/219 |
| D. 228,930 | 10/1973 | Leigh | 273/167 G X |
| D. 230,292 | 2/1974 | Gall | 273/167 G X |
| D. 230,750 | 3/1974 | Ehrich | D21/217 |
| D. 235,567 | 6/1975 | Cook | D21/217 |
| D. 258,377 | 2/1981 | Nordness et al. | D21/217 |
| D. 272,257 | 1/1984 | Perkins | D21/221 |
| D. 287,391 | 12/1986 | Shearer | D21/219 |
| 3,077,350 | 2/1963 | Koorland | 273/164 |
| 3,448,981 | 6/1969 | Anweiler | 273/80 R |
| 3,625,517 | 12/1971 | Durnack | 273/167 F |
| 3,967,826 | 7/1976 | Judice | 273/167 F |
| 4,199,144 | 4/1980 | Skelly | 273/164 |
| 4,227,694 | 10/1980 | Drake | 273/164 |
| 4,265,451 | 5/1981 | Bernhardt | 273/167 G |
| 4,325,553 | 4/1982 | Taylor | 273/167 F |
| 4,411,429 | 10/1983 | Drew et al. | 273/164 |
| 4,508,342 | 4/1985 | Drake | 273/80 C |
| 4,629,193 | 12/1986 | Pierman | 273/164 |
| 4,852,879 | 8/1989 | Collins | 273/164 |

FOREIGN PATENT DOCUMENTS

| | | | |
|---|---|---|---|
| 1129313 | 10/1968 | United Kingdom | 273/80 C |

*Primary Examiner*—Edward M. Coven
*Assistant Examiner*—Sebastiano Passaniti
*Attorney, Agent, or Firm*—Flehr, Hohbach, Test, Albritton & Herbert

[57] ABSTRACT

A golf club arrangement especially suitable for use as a putter, comprising an elongated shaft having a top hand gripping end and a bottom head assembly connecting end and a head assembly including a clubhead having a striking face and means for connecting said clubhead to the bottom of said elongated shaft, said head assembly being configured such that its center of gravity is positioned in front of the striking face of said clubhead.

25 Claims, 9 Drawing Sheets

NEUTRAL STABILITY

NEUTRAL STABILITY

POSITIVE ROTATIONAL STABILITY

POSITIVE ROTATIONAL STABILITY PUTTER

BACKGROUND OF THE INVENTION

1. Field of the Invention

The present invention relates generally to golf clubs and more specifically to a unique and novel golf putter head assembly having a configuration that locates its center of gravity forward of its strike face.

2. Description of the Prior Art

Gold is a sport which requires great timing, accuracy and a mechanical repetition uncommon to most other sports. A slight uncontrolled variation in the mechanics of a gold swing may result in adverse affects on the desired direction of the golf ball. This is also true in the putting aspect of golf. Although the putting stroke is not as mechanically involved at that required for an approach shot to the green, great accuracy, timing and mechanical repetition is also required for an effective putt.

Precise putting was originally, and rightly so, only associated with the skill of the player. That is, the golfer estimates a predetermined direction along with a predetermined impetus required to put the ball into the hold. Using his skill, mechanics and experience, he tries to emulate his estimation. If the ball is struck with sufficient force and in the proper direction, the ball will most likely fall into the hold. In practice, the striking face of the clubhead should be accurately normal to the initial direction of the putting stroke upon impact with the ball. Under these ideal conditions and if the impact occurs at the center of percussion (i.e. the point at which the clubhead will not rotate on impact, commonly called the "sweet spot"), then the ball will roll in the desired direction. However, such idealistic conditions rarely occur due to golfer, putter and environmental irregularities. Any inadvertent misalignment of the clubhead with respect to the ideal mechanics will produce adverse affects on the desired direction of the ball.

Heretofore, the skill of the player had been the primary factor associated with effective putting, as indicated above; therefore, the static and dynamic characteristics of the clubhead itself were rarely major design considerations. The skill of the golfer, without a doubt, is still the most significant factor for effective putting; however, professionals and amateurs alike agree that in their hands some putters perform better than others.

With the recent increased interest in golf, putter designers have conducted extensive research and development to improve the performance, capabilities and accuracy of the golf club. Most of these designs attempt to balance and distribute the weight of the clubhead so as to minimize twisting of the clubhead or to reduce the torque created due to improper alignment of the clubface when the impact with the ball does not occur at the center of percussion or when the clubhead is slightly misaligned with respect to the plane normal to the initial direction of the putting stroke. Different design approaches have included various weight distributions of the clubhead which have intentionally coincided the center of gravity with the center of percussion of the clubhead. Traditionally, the "sweet spot" has been located at or behind the center of the strike face of the clubhead. Impact with the ball at this point will not deflect or rotate the clubhead. Others designs have distributed the mass so that the center of gravity is located toward the heel or the toe portions of the clubhead for various reasons. Basically, the designers claim that these different weight distributions produce true pendulum movement of the golf stroke. Furthermore, they claim that these weight distributions decrease torque about the center of gravity created during impact with the ball when the clubhead is misaligned or when impact with the ball does not occur at the "sweet spot".

Still, other design concepts have taken into consideration the mechanics of motion such as attempting to reduce the angular acceleration upon impact with the ball (i.e., to minimize the twisting of the clubhead). It is apparent that in order to accomplish the desired result, the putter design should be configured to minimize torque by maximizing the moment of inertia about the club center of gravity. It is commonly known to those skilled in the art that maximizing the moment of inertia about the club center of gravity minimizes the effects of any inadvertent misalignment of the club head during the stroke. Furthermore, a high moment of inertia also reduces the harmful effects of not striking the ball at the "sweet spot" or center of the strike face. Some of these designs have concentrated mass distributions at the heel, toe and shaft portions of the club to produce a larger moment of inertia while simultaneously locating the center of gravity directly at or behind the strike face of the club. Typical examples of these prior art approaches set forth above may be seen in the following U.S. Pat. Nos.:

| | |
|---|---|
| D211,103 | COOK |
| D211,446 | COOK |
| D230,750 | EHRICH |
| D235,567 | COOK |
| D258,377 | NORDNESS ET AL. |
| D272,257 | PERKINS |
| D287,391 | SHEARER |
| 3,077,350 | KOORLAND |
| 3,448,981 | ANWEILER |
| 4,199,144 | SKELLY |
| 4,325,553 | TAYLOR |
| 4,508,342 | DRAKE |
| 4,629,193 | PIERMAN |
| 4,265,451 | BERNHARDT |

Under ideal mechanical and dynamic conditions, the golfer accelerates the putter clubhead coming out of his back stroke advancing it toward the ball wherein impact with the ball will be at the center of percussion and the strike face of the clubhead will be completely normal to the initial direction of the putting stroke. If the golfer does all of this, the ball will travel in the desired direction. In this situation, the skill of the golfer is the predominant factor for effective putting, whereas the design characteristics of the putter are essentially irrelevant. Unfortunately, ideal dynamic conditions do not always occur with most, if not all, golfers. Common golfer irregularities include misalignment of the strike face, failing to strike the ball at the "sweet spot" of the clubhead, twisting of the clubhead upon impact or a combination thereof. If any of these inadvertent conditions or combinations prevail, the clubhead may effectuate angular acceleration on the ball about an axis vertical to the ball. Thus, after impact, the motion of the ball will be influenced by an undesirable component of angular velocity about an axis vertical to the ball. This resulting spin is analogous to the infamous "slice" or "hook" in a conventional approach shot. This spin about a vertical axis imparted to the ball at impact makes it in effect a moving gyroscope. This friction force of the grass surface will then cause a precession about a horizontal axis, thus making the ball change direction, the change in direction being dependent upon the direction the spin imparted. Therefore, it is desired to impact the ball with the clubhead face completely normal to the initial direction of the putting stroke.

Due to these considerations, it is apparent that the best alternative is to design a clubhead which will tend to correct any misalignment during the forward putting stroke. The prior art set forth above has tried to minimize the effects of a misaligned club head during impact or minimize the effects of hitting the ball at the heel or toe portion of the club face. However, none of these approaches attempt to correct such inadvertent misalignment during the forward motion of the swing or upon impact with the ball such as the present invention does. As will be described in much greater detail below, this is accomplished in large part by locating the club head behind its elongated shaft using an offset neck and locating the center of gravity of the club head forward of the strike face, but rearward of the juncture between the bottom end of the elongated shaft and the top of the offset neck of the clubhead assembly. Any inadvertent misalignment of the strike face normal to the initial direction of the clubhead will tend to be corrected by a restoring moment about the center of gravity of the assembly. Similarly, if the misalignment, although reduced, is not totally corrected, then upon impact with the ball, a second correcting moment is provided which further reduces any misalignment (i.e. positive rotational stability). While other designs attempt to minimize the effects of misalignment, the present invention not only minimizes the effects but also reduces such misalignment.

SUMMARY OF THE INVENTION

Accordingly, it is a principal object of the present invention to provide a putter which locates its center of gravity forward of the strike face, providing positive rotational stability upon impact with the ball. Any inadvertent misalignment of the clubhead assembly (i.e. misalignment of the strike face normal to the initial direction of the putting stroke) during impact with the ball will be reduced, bringing the clubhead face back toward proper alignment.

Another object of the present invention is to provide a bent coupling weighted insert at the juncture point between an offset neck which connects the clubhead to the elongated shaft, and the bottom end of the shaft. Such a weighted insert effectuates a three-fold benefit: first, it moves the center of gravity forward of the strike face; second, it increases the moment of inertia of the club head assembly about the vertical axis through the assembly's center of gravity; and third, it allows the designer to employ different lie angles of the club shaft (i.e., the angle between the club shaft and a vertical axis).

Still another object of the present invention is to provide a putter wherein the bottom end of the clubhead shaft is connected to the offset neck at a point forward of both the center of gravity of the clubhead assembly and of the clubhead itself. Thus, the golfer feels the stabilizing mass which pulls the clubhead through the ball, correcting any minor misalignments during the acceleration of the forward stroke and, thereby, improving directional stability of the clubhead. This provides both physical as well as psychological advantages.

A further object of the present invention is to provide a putter wherein the juncture point between the elongated shaft end and the offset neck, the center of gravity of the clubhead assembly, the offset neck itself and the center of percussion are all located entirely within a vertical plane which is a perpendicular bisector of the strike face of the clubhead. Thus, due to the aforesaid dynamic conditions upon the acceleration of the forward stroke, the correction of the inadvertent minor misalignment will ensure contact at the center of percussion.

The advantage of the putter described herein is that a misaligned clubhead will be reduced or eliminated during the forward stroke and upon impact with the ball. Accordingly, the strike face will be closer to the ideal position desired, that is, normal to the initial direction of the putting stroke and impact will be closer to the center of percussion of the assembly. Therefore, by correcting or reducing the misalignment itself, the average golfer will enjoy a more accurate putt.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Reference will now be made in detail to the preferred embodiments of the invention, examples of which are illustrated in the accompanying drawings. While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

Figure 1:
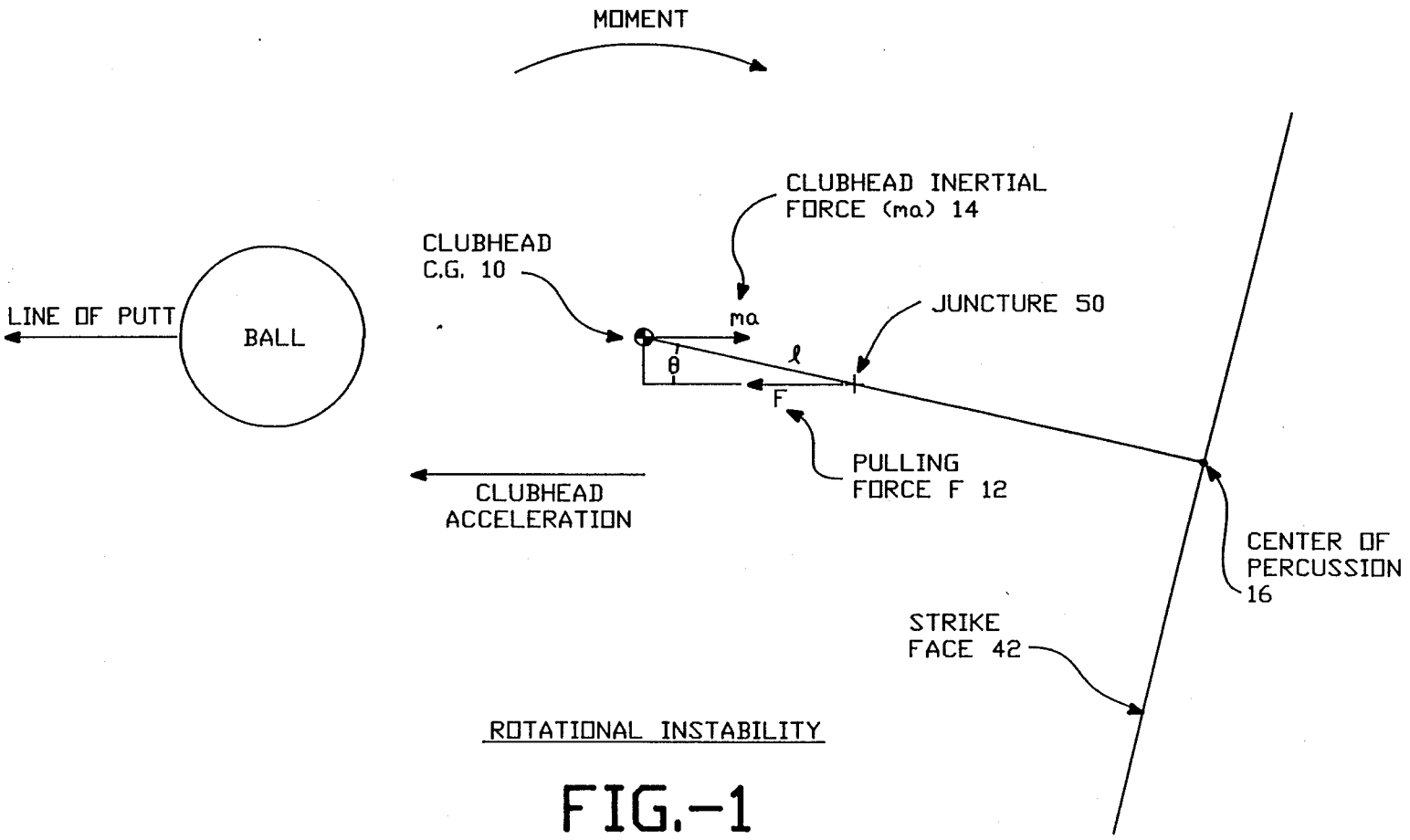
FIG. 1 is a diagram of the dynamics occurring due to a misaligned clubhead during the acceleration of the forward stroke but before impact with the ball, where the clubhead is configured such that the juncture between the offset neck and the elongated shaft is behind the center of gravity of the clubhead assembly.
Figure 2:
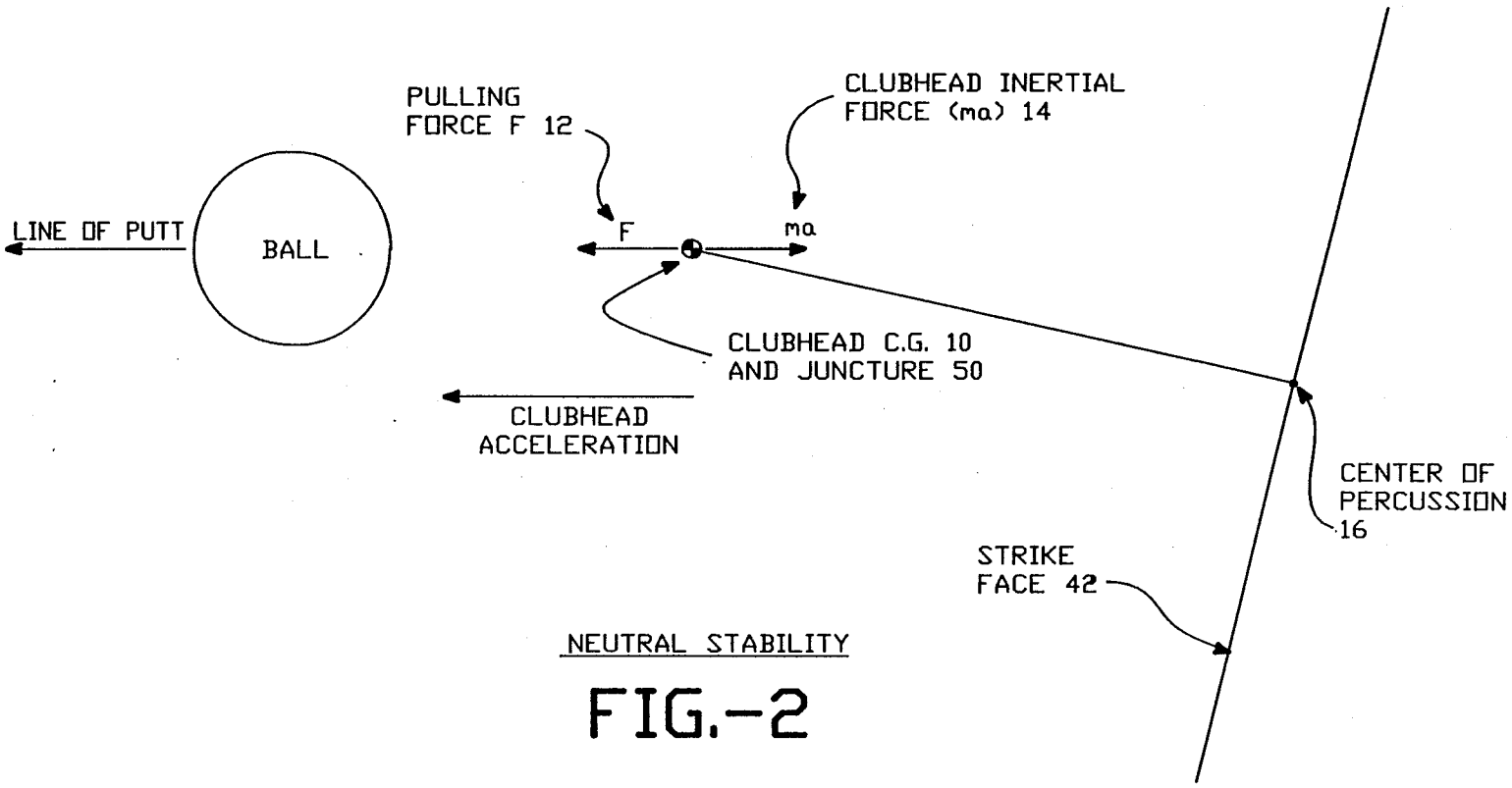
FIG. 2 is a diagram of the dynamics occurring due to a misaligned clubhead during the acceleration of the forward stroke but before impact with the ball, where the clubhead is configured such that the juncture between the offset neck and the elongated shaft is coincident with the center of gravity of the clubhead assembly.
Figure 3:
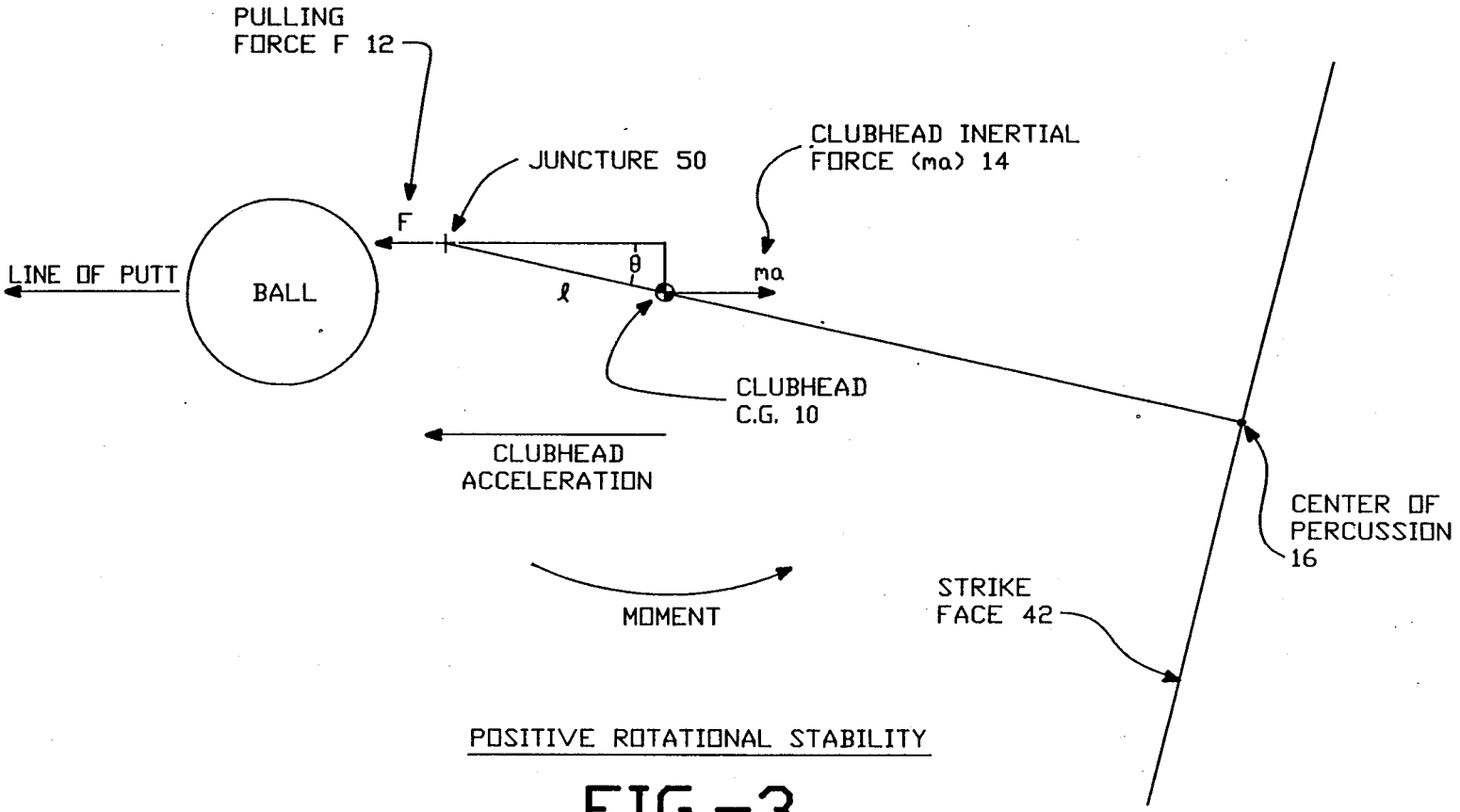
FIG. 3 is a diagram of the dynamics occurring due to a misaligned clubhead during the acceleration of the forward stroke but before impact with the ball, where the clubhead is constructed according to the present teachings such that the juncture between the offset neck and the elongated shaft is forward of the center of gravity of the clubhead assembly

The detailed description of the present invention is directed both to the physical structure and the dynamic theories and concepts involved which cooperated to produce the intended result. Therefore, it is appropriate to first set forth a brief description of these theories and concepts utilized. This brief discussion of the dynamic concepts occurring during the forward stroke will be separated into two parts: the dynamics before impact with the ball and the dynamics involved during impact with the ball. Additionally, due to the variety of figures presented, like components are designated by like reference numerals throughout the various figures. FIGS. 1 through 3 are directed toward the dynamics involved before impact with the ball. Similarly, FIGS. 4 through 6 describe the dynamics of a misaligned clubhead during impact with the ball.

The conventional putting stroke consists of a slow, approximately uniform velocity backstroke, and a forward stroke uniformly accelerating through the ball. Ideally, one aspires to have the clubhead face approximately normal to the initial direction of the putting stroke during the backstroke and forward stroke, and upon precisely normal at impact with the ball. Unfortunately, due to the golfer, putter and circumstantial irregularities, the clubhead is often inadvertently misaligned with respect to the aforesaid normal position. The dynamics of the misaligned clubhead during the forward acceleration stroke and during impact with the ball is the subject of this brief discussion. FIGS. 1 through 3 describe the dynamics of the misaligned clubhead during the acceleration of the forward stroke, but before impact with the ball.

The teachings of the present invention are more closely related to the type of golf putters in which the juncture between the bottom of the club shaft and the offset neck occur midway between the clubhead with respect to the elongated portion of the clubhead. (i.e. the juncture point lies within a vertical plane wherein the vertical plane is also normal to and a perpendicular bisector of the striking face of the clubhead). More specifically, in accordance to the teachings of the present invention, the center of gravity of the clubhead assembly, the juncture point and the center of percussion all lie entirely within the aforesaid vertical plane. Opposing this configuration are the conventional designs which secure the shaft end to the offset neck near the heel or even at the toe portion of the clubhead. An even more traditional approach is to just connect the end of the shaft directly to the heel portion of the clubhead thereby eliminating the offset neck. More unique is the construction according to the present teachings which locate the juncture point forward of the center of gravity of the clubhead assembly, while the center of gravity itself is forward of the clubhead strike face. The specific benefits of such a configuration will be more fully described below. This is in contrast to the traditional placements of the juncture either behind the center of gravity or coincident with it.

It will be noted that for the purposes of the dynamic discussions of FIGS. 1 through 3 exclusively, the strike face 42 location of the clubhead is largely irrelevant and will be relocated behind the end of the shaft and the center of gravity of the clubhead 10. This relocation is only for clarity purposes in order to obtain a better understanding of the dynamics occurring during the acceleration of the forward stroke. Furthermore, these diagrams are in reference to the horizontal plane and disregard the vertical difference.

FIG. 1 refers to such a configuration wherein the juncture point 50 between the bottom end of the shaft and the offset neck of the clubhead assembly (hereinafter referred to as the "juncture point") occurs at a point behind the center of gravity of the clubhead assembly 10 (i.e. the clubhead assembly is comprised of the clubhead and the offset neck, where the center of gravity, hereinafter referred to as "C.G.," is the summation of the 2 components). As set forth above, the discussion of FIGS. 1 through 3 are more closely related to club configurations where the juncture point 50 and the C.G. 10 lie within the same plane. Here, strike face 42 is misaligned by an angle $\theta$ from the ideal position normal to the initial direction of the putting stroke. As illustrated in FIG. 1, a couple is created due to the pulling force (F) 12 at the end of the shaft and the clubhead inertial force 14. The clubhead inertial force 14 is the resistance force (ma) due to the product of the mass of the clubhead assembly mass "m" and the acceleration "a" of the clubhead initiated by the golfer upon his forward stroke. Similarly, F represents the shaft end pulling force 12 transferred from the top of the shaft, due to the shafts rigid body characteristics, upon the forward stroke This moment (M) acting about the C.G. 10 can be stated as follows:

$$M = F.l.Sin\theta$$

where l = the absolute horizontal distance between the juncture point 50 and the C.G. 10, F = pulling force 12, $\theta$ = the angle between the strike face 42 and the position normal to the initial direction of the putting stroke.

Since the juncture point 50 is located behind the C.G. 10, the resulting moment described above will be in the same direction as that of the initial misalignment. A configuration as such will have a tendency to increase the misalignment before impacting the ball. Thus, any inadvertent misalignment will be worsened and impact at the center of percussion 16 may not occur. This effect is termed "Rotational Instability."

As shown FIG. 2, the club configuration is such that the juncture point 50 and the C.G. 10 are coincident with respect to the horizontal plane. Upon forward acceleration of the clubhead and upon any misalignment of the strike face 42 by an angle $\theta$, the pulling force 12 and the inertial force 14 are coincident with one another. Because the two forces are concentrated through the same point, no additional couple is induced on the clubhead. Therefore, the initial misalignment is neither increased nor decreased. This effect is termed "Neutral Stability."

FIG. 3 is constructed according to the teachings of the present invention. Here, the juncture point 50 is located forward of the C.G. 10. Furthermore, the center of percussion 16 is located behind, but in the same vertical plane as, both the C.G. 10 and the juncture point 50. Applicant is unaware of any prior art claiming the physical and dynamic benefits that this configuration of the present invention sets forth. Upon any inadvertent misalignment of strike face 42 by an angle $\theta$ during the forward acceleration, the present invention actually decreases the initial misalignment. It is clearly illustrated in FIG. 3 that since the juncture point 50 is located forward of the C.G. 10, a restoring moment created between the clubhead inertial force 14 and the pulling force 12 equal to a magnitude of $F.l.\mathrm{Sin}\theta$ will counteract the initial misalignment. As set forth above, F represents the pulling force 12, while l is the horizontal distance between the juncture point 50 and the C.G. 10. Thus, any misalignment will be decreased due to this restoring moment whereby the center of percussion 16 will be realigned in its proper ideal position (i.e. where impact with the ball ideally occurs). This is termed "Positive Rotational Stability. " An additional benefit of this novel configuration is that a larger fraction of the initial energy and momentum of the clubhead exerted by the golfer will be applied to the ball rather than being partially dissipated due to clubhead rotation and angular momentum about the C.G. 10. That is, more of the energy of the clubhead will be transferred upon impact and will propel the ball the intended distance This, of course, produces a more accurate putt.

Figure 10:
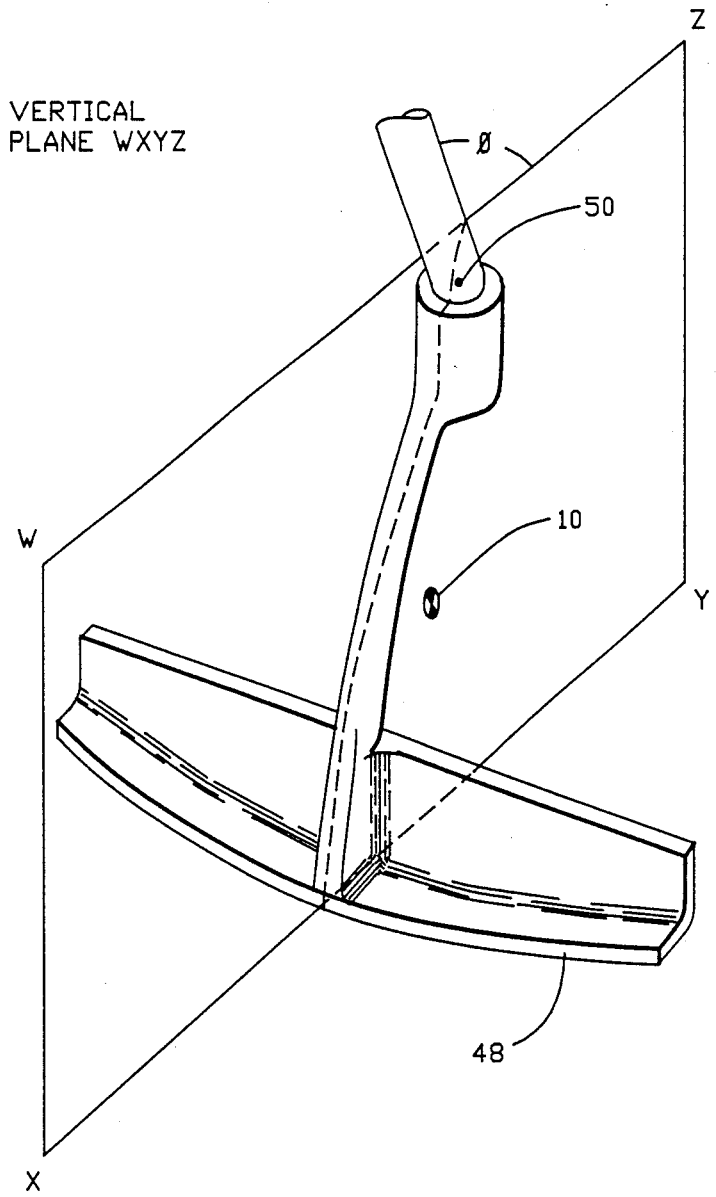
FIG. 10 is a perspective view of the golf putter constructed according to the teachings of the present invention.
Figure 11:
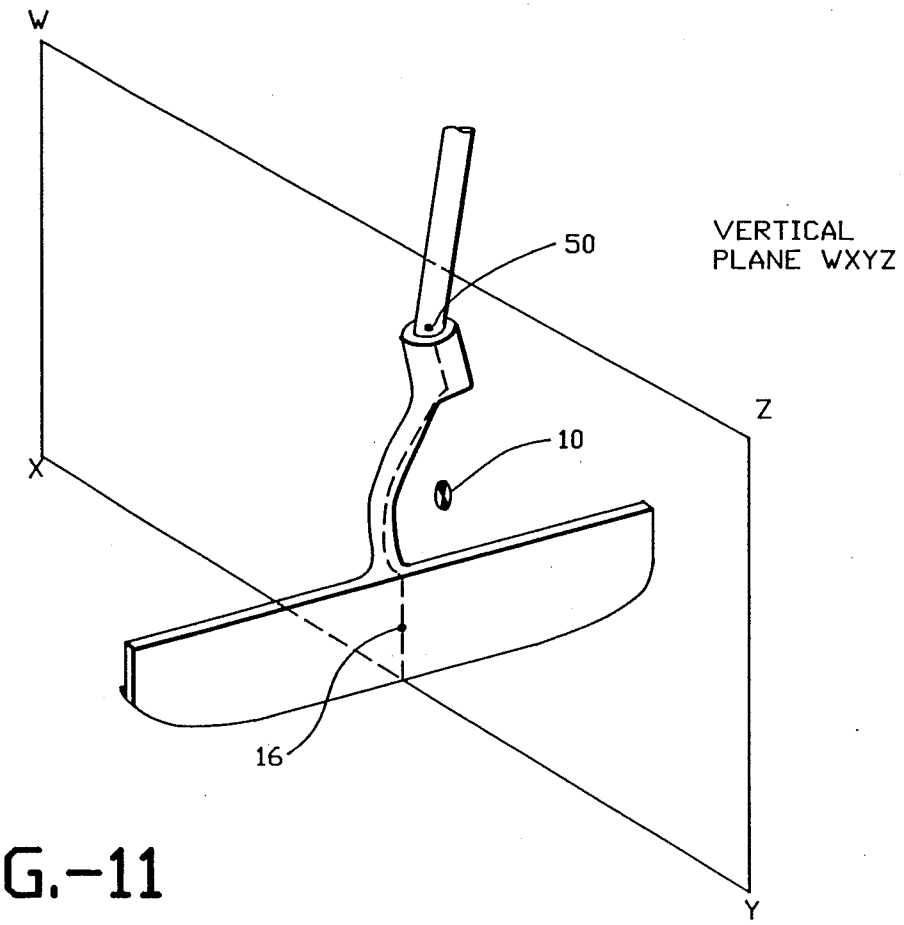
FIG. 11 is another perspective view according to the teachings of the present invention.

It is noted here, and also above, that one of the novelties of the present invention is that the juncture point 50, the C.G. 10 and the center of percussion 16, respectively, all lie within the same vertical plane. This is clearly exemplified in FIG. 3 as well as perspective views FIGS. 10 and 11.

Figure 4:
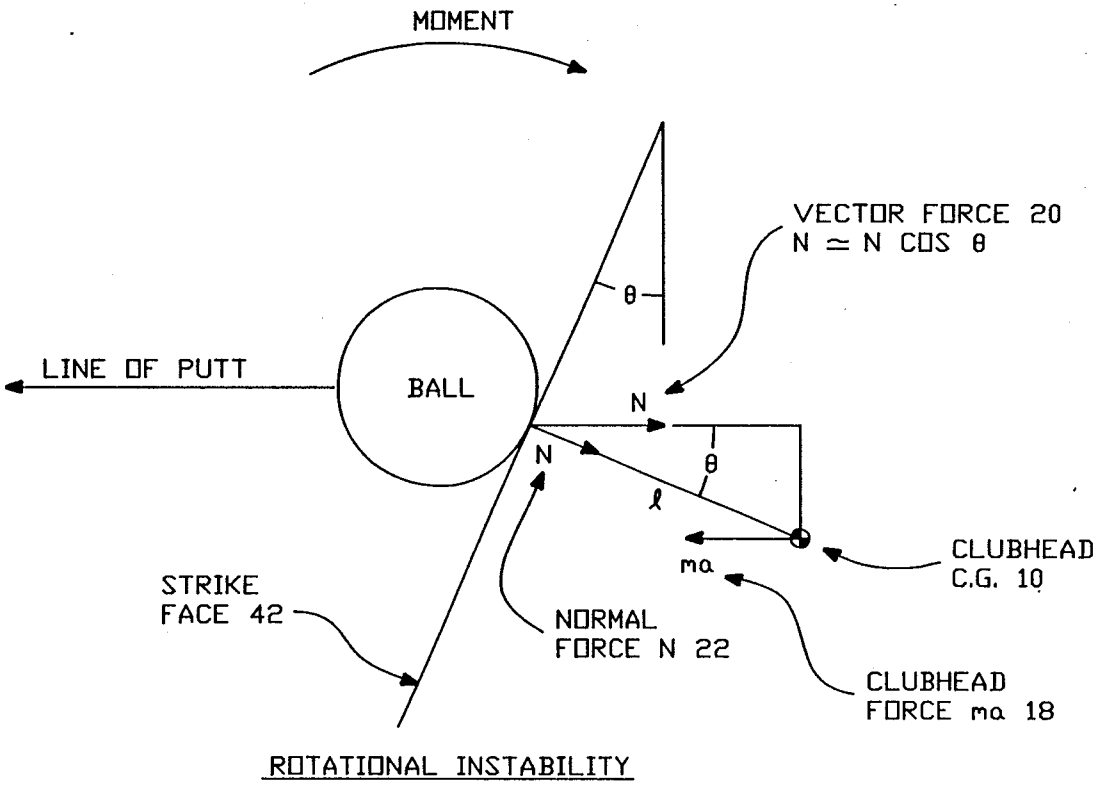
FIG. 4 is a diagram of the dynamics occurring due to a misaligned clubhead during impact with the ball, where the clubhead is configured such that the center of gravity of the clubhead assembly is located behind the strike face of the clubhead.
Figure 5:
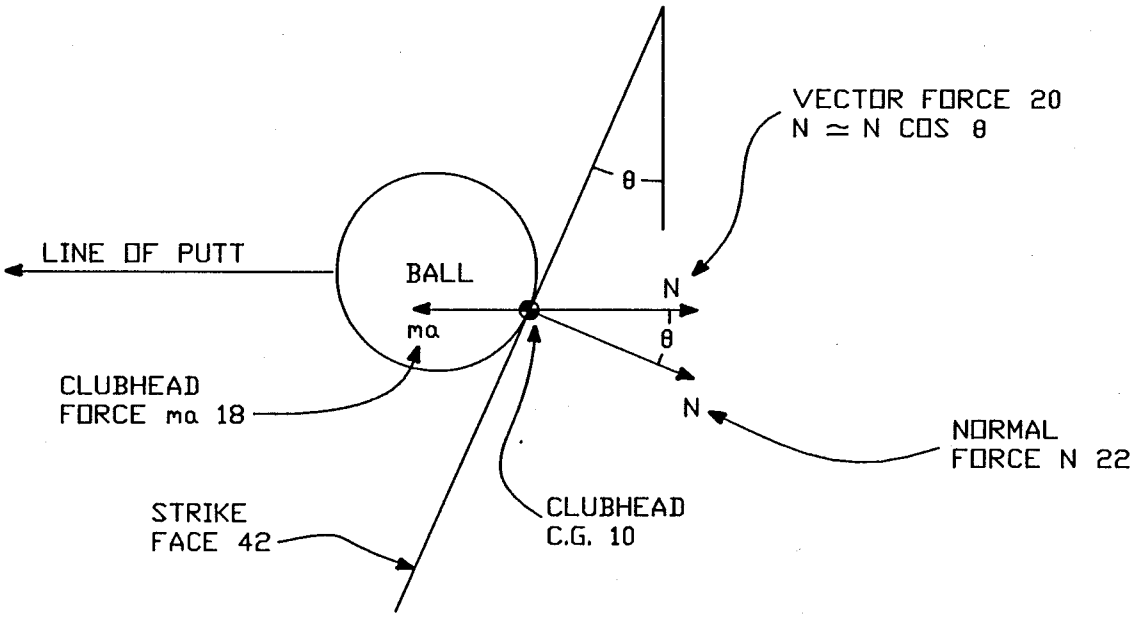
FIG. 5 is a diagram of the dynamics occurring due to a misaligned clubhead during impact with the ball, where the clubhead is configured such that the center of gravity of the clubhead assembly is coincident with the strike face of the clubhead.
Figure 6:
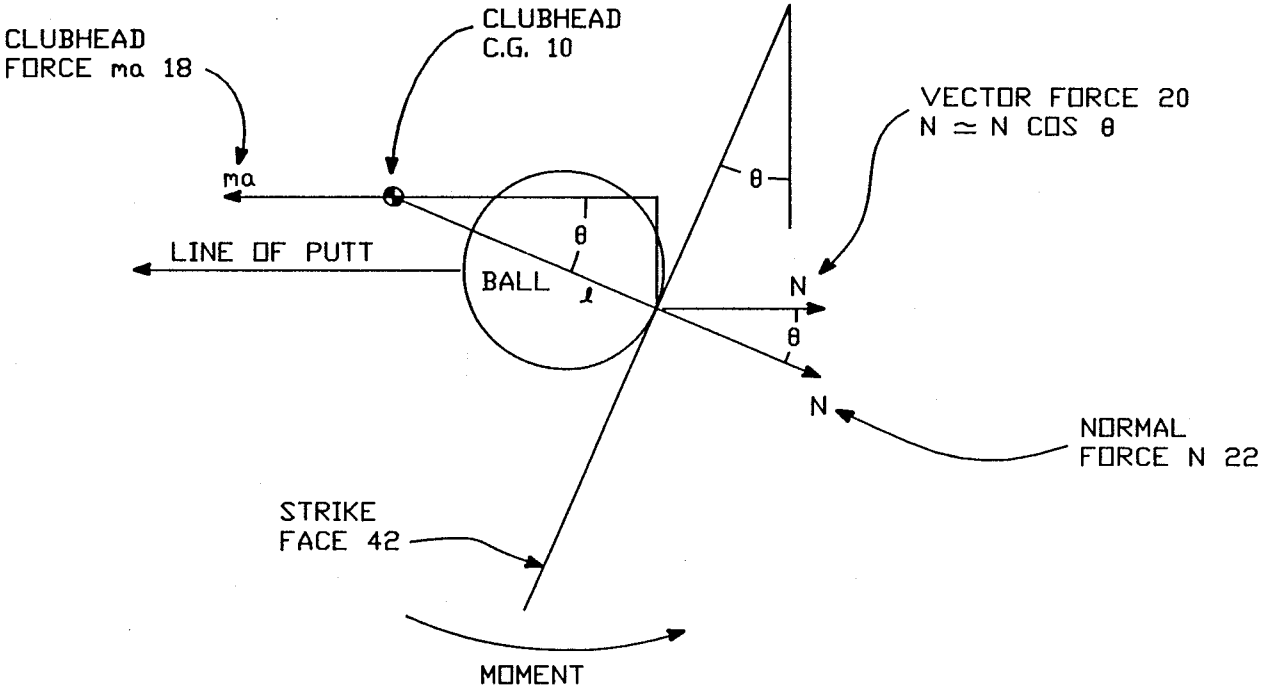
FIG. 6 is a diagram of the dynamics occurring due to a misaligned clubhead during impact with the ball, where the clubhead is constructed according to the present teachings such that the center of gravity of the clubhead assembly is located forward of the strike face of the clubhead

The second set of diagrams, FIGS. 4 through 6, refer to the dynamics of a misaligned clubhead during impact with the ball. The putter configurations of FIGS. 4 and 5 represent conventional putters wherein the clubhead assembly center of gravity 10 (hereinafter "C.G.") is located either behind the strike face 42 or coincident to it. FIG. 6 represents the configuration according to the teachings of the present invention where the C.G. 10 is located forward of the strike face 42. Upon impact with the ball an equal and opposite force will be imparted against the clubhead. This opposing normal force is designated N, 22 in the FIGS. 4 through 6, where the magnitude of N is a fraction of the total clubhead force (ma) 18, which is transferred during impact with the ball. Simply stated, N is equal and opposite the force imparted on the ball during impact. The magnitude of normal force 22 (i.e. the fraction of the total clubhead force 18 transferred) is dependent on a number of factors including the flexibility and damping factor of the shaft and clubhead assembly; the force exerted by the golfer; and the angular momentum of the clubhead. It is noted here that the total clubhead force 18 is equal and opposite the inertial force 14 stated above, where "m" is the total mass of the clubhead assembly while "a" represents its forward acceleration. It will further be observed that the angle of misalignment, $\theta$, represented in the FIGS. 4 through 6 is highly exaggerated here for clarity purposes. Generally, even golfers of lesser talent will not have the clubhead misaligned from the normal position by more than $\pm 5$ during a putting stroke. Therefore, the vector force component 20 is approximately equal to the normal force 22. This can be exemplified by the following equation $$N.\mathrm{Cosine}\theta \approx N$$

because the resulting cosine of this angle is approximately 1.

FIG. 4 represents a conventional putter wherein the C.G. 10 is aligned behind the strike face 42. In this configuration, during impact with the ball, the vector force 20 induces a moment about the C.G. 10 equal to $$M = N.l.\mathrm{Sin}\theta$$

where l = the absolute horizontal distance between the impact point and the C.G. 10, N = the vector force component 20 (i.e. $N.\mathrm{Cosine}\theta$).

The aforesaid moment will be in the same direction as the initial misalignment which tends to increase and worsen it. Therefore, upon impact, the misalignment will be greater than before impact. Consequently, more angular momentum is imparted on the ball, increasing the angular velocity about its vertical axis and reducing the accuracy of the putt. This is again referred to as "Rotational instability."

FIG. 5 also represents a traditional design which aligns the C.G. 10 to be coincident with the strike face 42. As one can see from the diagram, the vector force 20 and the clubhead force 18 are nearly coincident, with respect to the horizontal plane, for all intensive purposes. Therefore, no additional moment is effectuated during impact with the ball and the resulting angular velocity will be only that contributed from the initial inadvertent misalignment of the clubhead. This is also referred to as a "neutral stability." Although the impact will not affect the initial misalignment, the resulting putt will not be an accurate rendition of the golfers anticipation because some of the energy of the estimated total will be converted into angular momentum upon impact with the ball.

Lastly, FIG. 6 represents the unique approach of the present invention. This configuration, deemed the "positive rotational stability" putter, aligns the C.G. 10 forward of the strike face 42. As already set forth above, this putter actually decreases misalignments of the clubhead during impact with the ball. It is easily shown in FIG. 6 that during impact with the ball, the vector force 20 induces a restoring moment about the C.G. 10 equal to N.l.Sin$\theta$, where l is the distance between the impact point and the C.G. 10 and N is the vector force component 20 as discussed above. This restoring moment tends to decrease the initial inadvertent misalignment of the clubhead. Therefore, upon impact, the misalignment will be less than before impact, resulting in a truer more perfect putt.

Figures 7, 8, 9, 12, 13, 14:
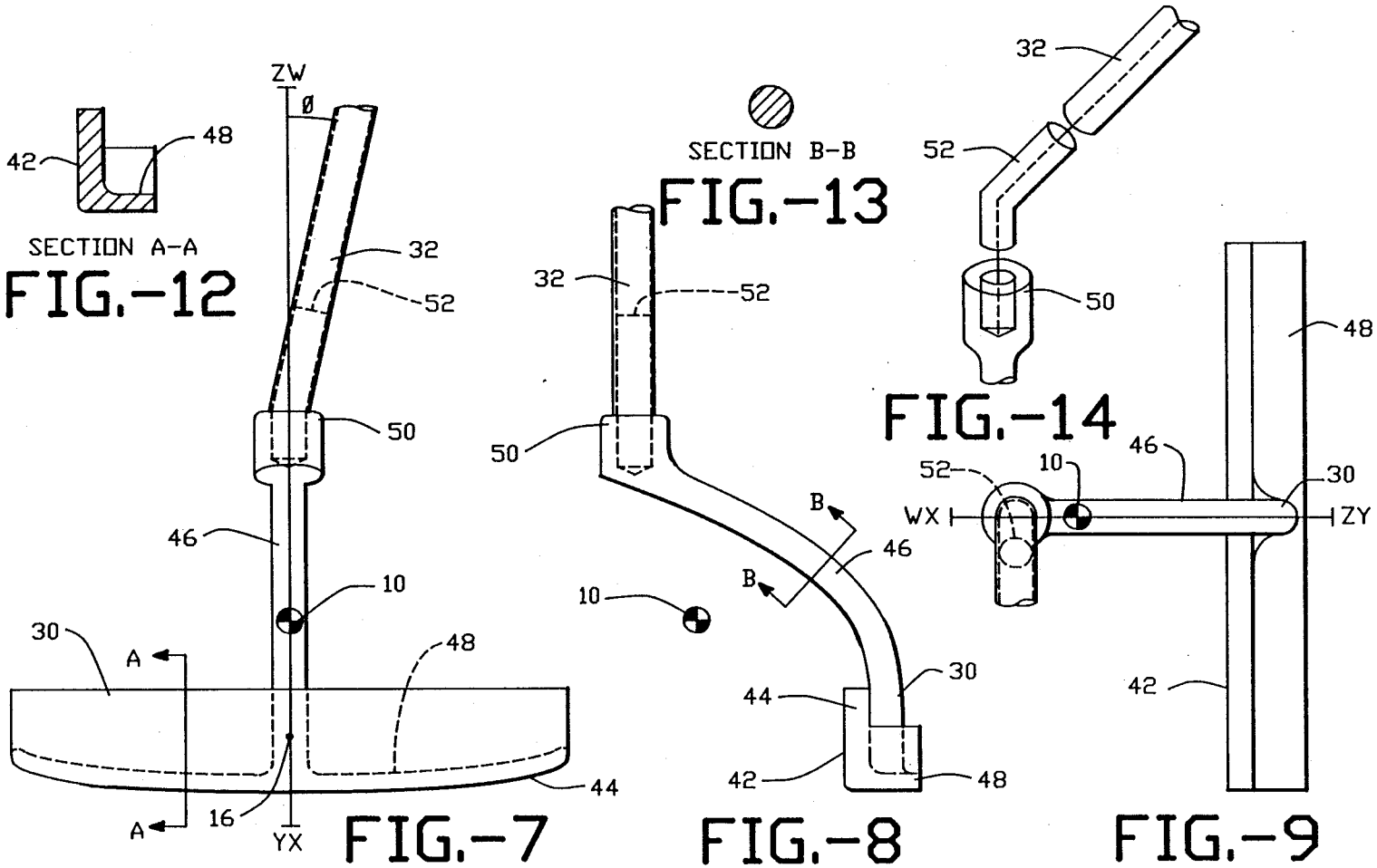
FIG. 7 is a front view of the golf putter in its preferred embodiment and shows that the center of gravity of the clubhead assembly, weighted insert, offset neck and juncture between the elongated shaft and the offset neck are all in the same vertical plane.
FIG. 8 is a side view of the golf putter in its preferred embodiment and clearly shows the location of the center of gravity of the clubhead assembly forward the strike face of the clubhead but behind the juncture between the elongated shaft and the offset neck.
FIG. 9 is a top view of the golf putter in its preferred embodiment and again shows the placement of the center of gravity with respect to the strike face and the juncture. Furthermore, this figure demonstrates how the offset neck, center of gravity, juncture point and weighted insert all lie in the same vertical plane
FIG. 12 is a sectional view along the line A-A of FIG. 7.
FIG. 13 is a sectional view along the line B—B of FIG. 8.
FIG. 14 is a closeup view of the bent coupling weighted insert at the juncture between the offset neck and the bottom of the shaft

Referring now to the drawings in greater detail, there is illustrated in FIG. 7 a golf club embodying the teachings of the present invention having a clubhead assembly generally identified by reference numeral 30 and an elongated shaft 32. Clubhead assembly 30 comprises a clubhead 44 and an offset neck 46 affixed midway between the heel and toe portions of clubhead 44 extending upward and forward of clubhead 44. This is more clearly observed in FIG. 8. The most prominent features of clubhead 44 are its flat front striking face 42, which is contained entirely within a vertical plane, and its horizontally or axially elongated side-to-side shape as compared to its vertical height.

In its preferred embodiment, clubhead 44 has a solid elongated body composed of materials such as beryllium-copper alloy, stainless steel, aluminum, magnesium or the like. However, materials such as plastic, ceramincs, wood or composition thereof are not excluded as possibilities. FIG. 7 shows a front view of the strike face 42 in its preferred shape where it is basically rectangular with the exception of the bottom ends of the heel and toe portions which extend slightly upwards in a semi-elliptical shape. It will be observed upon further inspection of FIGS. 8 and 9 that the clubhead basically consists of the strike face which is fairly thin, maybe ¼ inch to a ½, and a thin protruding lip 48. This lip 48 conforms to the semi-elliptical shaped upward extensions of the heel and toe portions of strike face 42 as clearly illustrated in FIG. 7 and especially in the perspective view of FIG. 10. Furthermore, FIG. 12 sets forth a cross sectional view along the line of A—A of FIG. 7 which clarifies the location of the protruding lip 48. This L-shaped configuration of clubhead 44 attributes to its light weight which enables the designer to locate the center of gravity 10 forward of strike face 42. The actual mass properties of the clubhead assembly 30 will be discussed below.

Referring now to FIG. 8, the extension upward and forward from clubhead 44 of offset neck 46 is clearly illustrated. In its preferred embodiment, the material composition will be similar, if not identical, to that of clubhead 44. However, composite structures may be highly desirable considering the mass distribution necessary to accomplish the desired result. A denser material may be used near the upper portion of the offset neck 46 in order to displace the C.G. 10 forward and upward from the strike face 42.

Upon closer inspection of the figures, it is apparent that offset neck 46 is affixed to the backside of the strike face 44 and extends all the way down to the base of protruding lip 48. FIGS. 7 through 9 thoroughly demonstrate the securement of offset neck 46 with respect to clubhead 44 as well as its location directly midway between the heel and toe portions. In its preferred embodiment, offset neck 46 is approximately cylindrical in structure, as shown in FIG. 13 which is a sectional view along the line B—B of FIG. 8. Moreover, the offset neck 46 is a parabolic arc shape as observed in FIG. 8. The primary function of the offset neck is to displace the clubhead 44 rearward of the juncture point 50 between the elongated shaft 32 and the offset neck 46. To achieve the desired product, one is not confined to the parabolic configuration or the cylindrical structure of the aforesaid preferred embodiment. Any geometric configuration accomplishing the same result may suffice.

At the upper portion of offset neck 46 is the juncture point 50 between the offset neck 46 and the elongated shaft 32 as illustrated in FIGS. 7 and 8. The diameter of offset neck 46 is fairly constant until juncture 50 is reached where upon there occurs a noticeable diameter increase in order to accommodate a bent coupling weighted insert 52, hereinafter referred to as "weighted insert." It will thus be observed that the weighted insert 52 for all intensive purposes is incorporated into the discussed mass properties of the clubhead assembly 30. This weighted insert 52 performs several functions of which the most trivial is the fastening of the clubhead assembly 30 to the elongated shaft 32. However, the primary and essential function according to the teachings of the present invention is the fact that this forward weight aligns the C.G. 10 of clubhead assembly 44 forward of strike face 42. The dynamic relevance of placing C.G. 10 between strike face 42 and juncture 50 have already been discussed above. Insert 52 is composed of a tungsten alloy in its preferred embodiment, but is not limited to this material. Any material denser than that of the clubhead assembly will suffice. The actual size of the weighted insert 52 will depend on the density of the material and the desired location of C.G 10. It will be noted here that C.G. 10 may be adjusted, either closer to the hosel-shaft juncture point 50 or closer to the clubhead 44. A simple variation in the weight of insert 52 achieves this result. In a sense, one may adjust the magnitude of the restoring moment.

Weighted insert 52 is embedded in a socket bored into the top portion of offset neck 46 as shown in FIG. 8. Similarly, the other end is embedded in the bottom of elongated shaft 32. FIG. 14 is an expanded view which visually portrays this idea. It is apparent that bent coupling weighted insert 52 controls the angle of inclination or the "lie angle" of elongated shaft 32. This is the angle between elongated shaft 32 and vertical plane WXYZ as shown by angle $\phi$ in FIG. 7. Therefore, another feature of weighted insert 52 allows one to vary the "lie angle" as shown in additional FIGS. 10 and 14. This angle must exceed 10 degrees in order to comply with the USGA rules. However, this "lie angle" may vary according to the height of the golfer and his preference of the horizontal distance between his feet and clubhead 44. This is clearly a personal preference and does not change the design characteristics of the clubhead assembly 30.

Another pertinent object of the present invention is the alignment of the hosel-shaft juncture point 50, the C.G. 10, the offset neck 46 and the center of percussion 16 all within the same vertical plane. This plane, designated WXYZ, is the perpendicular bisector of strike face 42 and is clearly illustrated in the perspective view of FIG. 10. Additional views of vertical plane WXYZ are represented by line ZW-YX in FIG. 7 and line WX-ZY in FIG. 9. The dynamic benefits of such an array of the aforesaid physical elements have been set forth above.

Because the concentrated weight of insert 52 is located farther up the juncture point 50, the C.G. 10 is located toward the hands or the top of elongated shaft 32. Thus, the "swing weight" (i.e. effective moment of the club about the hands) is reduced. This allows the possibility of adding additional weight to the clubhead, thereby increasing the moment of inertia about the clubhead C.G. and reducing misalignment tendencies, without making the club "feel" any heavier to the golfer.

The weighted insert 52 has an additional benefit of increasing the overall moment of inertia about the vertical axis through the C.G. 10. Because C.G. 10 is neither located in the same vertical axis as clubhead 44 nor that of weighted insert 52, the moment of inertia increase about the C.G. 10 is apparent. It is commonly known in the art that when effective weight concentrations are located away from the center of gravity of the clubhead assembly, the moment of inertia about a vertical axis through the C.G. is increased. As discussed previously, an increase in the moment of inertia reduces the hazardous effects of striking the ball towards the heel or toe portions of clubhead 44. Therefore, weighted insert 52 helps to reduce these adverse effects.

Although not shown in any of the figures, the present invention may incorporate weights fixed to the heel and toe portions of the protruding lip 48 or to the backside of the striking face 42. These weights may be composed of tungsten, lead or the like and be affixed by equal and opposite distances from vertical plane WXYZ.

What is claimed is:

1. A golf club arrangement especially suitable for use as a putter, comprising:

an elongated shaft having a top hand gripping end and a bottom head assembly connecting end; and a head assembly including a clubhead having a striking face and means for connecting said clubhead to the bottom end of said elongated shaft, said head assembly being configured such that its center of gravity is positioned forward of said striking face and rearward of a junction between the longitudinal axis said of shaft and said connecting means, whereby such physical arrangement maintains positive rotational stability both in the forward accelerating stroke and upon impact with a ball.

2. A golf club according to claim 1 wherein said connecting means connects said clubhead with said bottom end of the shaft at a location extending downward and rearwardly from said bottom end.

3. A golf club according to claim 1 wherein said head assembly is further configured such that said center of gravity is positioned vertically downward from said juncture.

4. A golf club according to claim 3 wherein said connecting means includes a top and a bottom end and is connected at its tope end to the bottom end of said shaft at said junction and is connected at its bottom end to said clubhead at said center of percussion.

5. A golf club according to claim 4 wherein said connecting means includes an offset neck extending forward and upward from the center of percussion of said clubhead to said juncture.

6. A golf club according to claim 5 wherein said connecting means includes weight means located adjacent said juncture, said weight means being denser than the rest of said connecting means.

7. A golf club according to claim 6 wherein said weight means includes a weighted member joining said neck with said shaft at said juncture.

8. A golf club according to claim 7 wherein said weighted member is configured to place said shaft at a predetermined angle with respect to said offset neck.

9. A golf club according to claim 3 wherein said center of gravity, said juncture, said connecting means and the center of percussion of the clubhead all lie in a common plane.

10. A golf club according to claim 1 wherein said connecting means includes a top end and a bottom end and is connected at its top end to the bottom end of said shaft wherein said connecting means includes weight means located adjacent said juncture and a neck below said weight means, said weight means being denser than said neck.

11. A golf club according to claim 10 wherein said weight means includes a weighted member joining said neck with said shaft at said juncture.

12. A golf club according to claim 11 wherein said weighted member is configured to place said shaft at a predetermined angle with respect to said offset neck.

13. A golf club according to claim 1 wherein said means for connecting said clubhead to the bottom end of said elongated shaft comprises an offset neck extending forward and upward from said clubhead to the bottom end of said elongated shaft, said offset neck being secured midway between a heel and a toe portion of said clubhead so as to define the center of percussion of the clubhead, said offset neck further situated so as to lie entirely within a vertical plane extending through a first point at the center of said strike face, said vertical plane being a perpendicular bisector of said strike face and a bisector of said offset neck.

14. A golf club according to claim 13 wherein said center of percussion, said center of gravity, and said first point all lie within said vertical plane.

15. A golf club according to claim 14 wherein said head assembly further includes a weighted insert composed of a material denser than that of the material composing said clubhead or said offset neck, said weighted insert situated at a juncture between said offset neck and the bottom end of said elongated shaft, said juncture occurring at a second point situated in front of both said center of gravity and the striking face of said clubhead, wherein said vertical plane also extends through said second point.

16. A golf club according to claim 15 wherein said weighted insert provides weight forward of said clubhead and further increases the moment of inertia about the vertical axis through the center of gravity of said head assembly, said weighted insert also permits a plurality of lie angles to be employed by said golf club, said lie angle being the angle between said elongated shaft and said vertical plane.

17. A golf club according to claim 16 wherein said offset neck is configured in a parabolic form.

18. A golf club arrangement especially suitable for use as a putter, comprising:

(a) an elongated shaft having a top hand gripping end and a bottom head assembly connecting end; and (b) a head assembly including (i) a clubhead having a striking face; and (ii) means for connecting said clubhead to the bottom end of said elongated shaft, said connecting means being at a location extending downwardly and rearwardly from said bottom end of said shaft, said connecting means further including a top end and a bottom end, said top end of said connecting means forming a juncture upon connection to said shaft, said bottom end of said connecting means connected to said clubhead at a center of percussion of said clubhead, an offset neck extending forward and upward from the center of percussion of said clubhead to said juncture, and a weighted member located adjacent said juncture and joining said offset neck with said shaft at said juncture, said weight means being denser than the rest of said connecting means;

(c) said head assembly being configured such that its center of gravity is positioned forward of said striking face of said clubhead and further lies in a common plane with said juncture, said connecting means and said center of percussion.

19. A golf club according to claim 18 wherein said weighted member is configured to place said shaft at a predetermined angle with respect to said offset neck.

20. A golf club arrangement especially suitable for use as a putter, comprising:

(a) an elongated shaft having a top hand gripping end and a bottom head assembly connected end; and (c) a head assembly including (i) a clubhead having a striking face, and (ii) means for connecting said clubhead to the bottom end of said elongated shaft, said connecting means further includes a top end and a bottom end and is connected at its top end to the bottom end of said shaft, wherein said connecting means includes weight means located adjacent said juncture and a neck below said weight means, said weight means being denser than said neck;

(c) said head assembly being configured such that its center of gravity is positioned forward of said striking face of said clubhead.

21. A golf club according to claim 20 wherein said weight means includes a weighted member joining said neck with said shaft at said juncture.

22. A golf club according to claim 21 wherein said weighted member is configured to place said shaft at a predetermined angle with respect to said offset neck.

23. A golf club arrangement especially suitable for use as putter, comprising:

(a) an elongated shaft having a top hand gripping end and a bottom head assembly connecting end; and (b) a head assembly including (i) a clubhead having a striking face, (ii) means for connecting said clubhead to the bottom end of said elongated shaft, said connecting means further including an offset extending forward and upward from said clubhead to the bottom end of said elongated shaft, said offset neck being secured midway between a heel and a toe portion of said clubhead so as to define the center of percussion of the clubhead, said offset neck further situated so as to lie entirely within a vertical plane extending through a first point at the center of said strike face, said vertical plane being a perpendicular bisector of said strike face and a bisector of said offset neck, and (iii) a weighted insert composed of a material denser than that of the material composing said clubhead or said offset neck, said weighted insert situated at a juncture between said offset neck and the bottom end of said elongated shaft, said juncture occurring at a second point situated in front of said clubhead;

(c) said head assembly being configured such that its center of gravity is positioned forward of said striking face of said clubhead, wherein said vertical plane further extends through said center of gravity, said second point, said connecting means and said center of percussion.

24. A golf club according to claim 23 wherein said weighted insert provides weight forward of said clubhead and further increases the moment of inertia about the vertical axis through the center of gravity of said head assembly, said weighted insert also permits a plurality of lie angles to be employed by said golf club, said lie angle being the angle between said elongated shaft and said vertical plane.

25. A golf club according to claim 24 wherein said offset neck is configured in a parabolic form.

* * * * *

UNITED STATES PATENT AND TRADEMARK OFFICE

CERTIFICATE OF CORRECTION

PATENT NO. : 4,966,369

DATED : October 30, 1990

INVENTOR(S) : Roy N. Griffin

It is certified that error appears in the above-identified patent and that said Letters Patent is hereby corrected as shown below:

Col. 1, line 11, delete "Gold" and insert therefor ---Golf---;

Col. 1, line 14, delete "gold" and insert ---golf---;

Col. 1, line 17, delete "at" and insert ---as---;

Col. 6, line 63, delete "M = F.l.Sin θ" and insert

---$M=F\cdot\ell\cdot Sin\theta$---;

Col. 6, line 66, delete "l" and insert

---$\ell$---;

Col. 8, line 25, delete

"$N.Cosine\theta\approx N$"

and insert

---$N\cdot Cosine\theta\approx N$---;

UNITED STATES PATENT AND TRADEMARK OFFICE

CERTIFICATE OF CORRECTION

PATENT NO. : 4,966,369

DATED : October 30, 1990

INVENTOR(S) : Roy N. Griffin

It is certified that error appears in the above-identified patent and that said Letters Patent is hereby corrected as shown below:

Col. 8, line 34, delete

"$M=N.1.Sin\theta$"

and insert

---$M=N\cdot\ell\cdot Sin\theta$---;

Col. 8, line 37, delete "l" and insert

---$\ell$---;

Col. 8, line 39 delete

"(i.e. N.Cosine$\theta$)"

and insert

---(i.e.$N\cdot Cosine\theta$)---;

UNITED STATES PATENT AND TRADEMARK OFFICE

CERTIFICATE OF CORRECTION

PATENT NO. : 4,966,369

DATED : October 30, 1990

INVENTOR(S) : Roy N. Griffin

It is certified that error appears in the above-identified patent and that said Letters Patent is hereby corrected as shown below:

Col. 11, line 52, delete "tope" and insert

---top---.

Signed and Sealed this

Eighteenth Day of February, 1992

*Attest:*

HARRY F. MANBECK, JR.

*Attesting Officer*

*Commissioner of Patents and Trademarks*